US006142068A

United States Patent [19]

Sebastian et al.

[11] Patent Number: 6,142,068

[45] Date of Patent: Nov. 7, 2000

[54] CONTINUOUS PRESS FOR MAKING PARTICLE BOARD

[75] Inventors: Lothar Sebastian, Bochum; Klaus Schürmann, Jüchen; Horst Weiss, Krefeld, all of Germany; Werner Gawlitta, Tegelen, Netherlands

[73] Assignee: G. Siempelkamp GmbH & Co., Krefeld, Germany

[21] Appl. No.: 09/152,931

[22] Filed: Sep. 14, 1998

[30] Foreign Application Priority Data

| | | | |
|---|---|---|---|
| Sep. 13, 1997 | [DE] | Germany | 197 40 325 |
| Jul. 3, 1998 | [DE] | Germany | 198 29 741 |
| Jul. 3, 1998 | [DE] | Germany | 198 29 742 |

[51] Int. Cl.[7] ..... B30B 5/06

[52] U.S. Cl. ..... 100/154; 156/583.5; 425/371

[58] Field of Search ..... 100/151, 152, 100/154; 156/555, 583.5; 425/371

[56] References Cited

U.S. PATENT DOCUMENTS

| | | | |
|---|---|---|---|
| 5,112,209 | 5/1992 | Ahrweiler et al. | 100/154 |
| 5,337,655 | 8/1994 | Bielfeldt | 100/154 |
| 5,404,810 | 4/1995 | Bielfeldt | 100/154 |
| 5,546,857 | 8/1996 | Gerhardt et al. | 100/154 |

FOREIGN PATENT DOCUMENTS

| | | |
|---|---|---|
| 44 33 641 | 11/1995 | Germany . |
| 195 18 879 | 12/1996 | Germany . |
| 197 40 325 | 5/1998 | Germany . |

*Primary Examiner*—Stephen F. Gerrity
*Attorney, Agent, or Firm*—Herbert Dubno; Andrew Wilford

[57] ABSTRACT

A press for pressing a mat into a thin panel has a press frame, upper and lower press plates on the frame, upper and lower press belts having confronting lower and upper stretches defining a press gap extending in a horizontal and longitudinal transport direction and respectively running below and above the upper and lower press plates, respective arrays of rollers between each press plate and the respective stretch, and upper and lower flexible intake plates juxtaposed respectively above and below upstream ends of the lower and upper stretches of the belts and defining therewith an intake mouth flaring upstream. An array of spaced differential hydraulic actuators is braced between at least one of the intake plates and the frame and is operable to deform the one intake plate and thereby change the spacings of the belts at the mouth. A controller connected to the actuators can therefore steplessly change the shape and position of the belts at the mouth.

7 Claims, 3 Drawing Sheets

CONTINUOUS PRESS FOR MAKING PARTICLE BOARD

FIELD OF THE INVENTION

The present invention relates to a continuous press. More particularly this invention concerns such a press for making chip board, particle board, flake board, and the like.

BACKGROUND OF THE INVENTION

In the production of chip board, flake board, fiber board, and the like it is standard to compress a relatively thick mat by a factor of eight or more into a hard panel. The mat is soft and comprised of wood particles mixed with a phenolic or other binder. The finished workpiece is a hard board or panel with a pair of planar faces.

Such a panel is produced in a continuous press having a rigid press frame having vertically spaced upper and lower parts defining a press gap that can extend some 30 m. Upper and lower belts are spanned in the respective press parts between respective upstream and downstream rollers, at least one of which is driven to advance confronting upper and lower stretches of the lower and upper belts longitudinally through the press. Upper and lower press plates bear, typically by some sort of roller arrangement, on the lower and upper surfaces of the upper and lower stretches of the lower and upper belts. Normally arrays of rollers run between each belt and the respective supporting plate to reduce friction.

The two belts typically are braced at an intake mouth of the gap against flexible intake members or plates. The mouth flares upstream, from a width of more than 100 mm that is wide enough to easily receive the incoming mat down to a dimension somewhat greater than the finished width of the panel, between 10 mm and 20 mm. These intake members are typically braced against the press frame by hydraulic cylinders that are hooked to a common controller so that the shape of the intake mouth can be set centrally. Such systems are described in German patent documents 195 18 879 and 197 40 325.

As described in U.S. Pat. No. 5,546,857 of Gerhardt the intake mouth is formed by a contouring slide guided on the press frame, a contouring drive operatively connected with the contouring slide for moving same back and forth along the frame, a plurality of steps on the slide extending transverse to a direction of feed through the press and disposed in a stop-defining staircase, and a counter bar selectively engageable by the steps in accordance with displacement of the slide. This counter bar is provided on the respective press platen and, by engagement with a selected step of the staircase, determines the configuration of a feed tongue.

These known systems provide at best a crude system for controlling the size and shape of the intake mouth. Normally the shape is fixed and the opening width can only be set in steps. Thus this system does not allow this critical part of the press to be set for a particular workpiece composition, size, and displacement speed.

OBJECTS OF THE INVENTION

It is therefore an object of the present invention to provide an improved continuous press for making fiber board and the like.

Another object is the provision of such an improved continuous press for making fiber board and the like which overcomes the above-given disadvantages, that is whose intake mouth can be steplessly adjusted both with regard to belt spacing and shape.

SUMMARY OF THE INVENTION

A press for pressing a thick mat into a thin panel has according to the invention a press frame, upper and lower press plates on the frame, upper and lower press belts having confronting lower and upper stretches defining a press gap extending in a horizontal and longitudinal transport direction and respectively running below and above the upper and lower press plates, respective arrays of rollers between each press plate and the respective stretch, and upper and lower flexible intake plates juxtaposed respectively above and below upstream ends of the lower and upper stretches of the belts and defining therewith an intake mouth flaring upstream. In accordance with the invention an array of spaced differential hydraulic actuators is braced between at least one of the intake plates and the frame and is operable to deform the one intake plate and thereby change the spacings of the belts at the mouth. A controller connected to the actuators can therefore steplessly change the shape and position of the belts at the mouth.

Thus with this system it is possible to deform the intake plate and thereby impart virtually any desired curvature to it to accommodate any workpiece material, size, or transport speed. When a very thick and soft mat is being pressed, the intake plates can be flared trumpet-like in a radical manner and when a relatively hard prepressed mat is fed in, they can converge at a very small acute angle.

Thus this system can be used with soft mats some 100 mm thick, and with thin ones only 3 mm thick, the latter often moving as fast as 1000 m/sec. In fact the system is particularly applicable to high-speed systems where it has been found that entrained air can form bubbles that in turn can cause mini explosions as their pressure is released, damaging the workpieces and often even the belts. With the instant invention it is possible to use what is in effect a very large radius of curvature for the sides of the mouth so that such bubbles do not form at all.

The actuators according to the invention are arrayed in longitudinal and transverse rows. In addition the one plate, normally the upper plate, is formed with longitudinally extending bores. Means is provided circulating a heating fluid through the bores.

A cardan or universal joint is provided between each of the actuators and the one plate. Furthermore to protect the actuators heat insulation is provided between the actuators and the one plate. In addition means can be provided for cooling the fluid in the hydraulic fluid network between the controller and the actuators.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
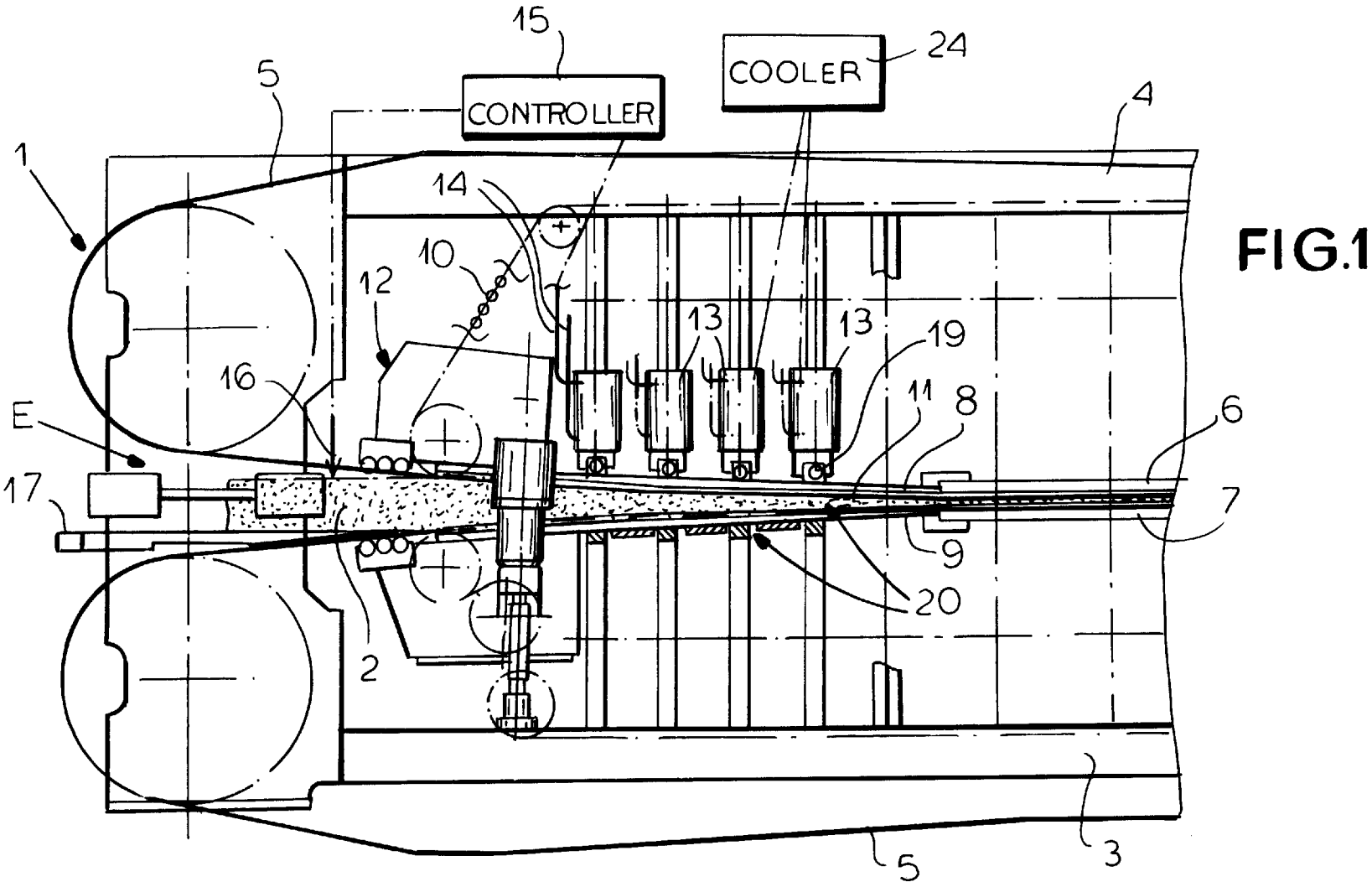
FIGS. 1 and 2 are side partly sectional and partly schematic views illustrating the press according to the invention, working with a thick and thin mat.
Figure 2:
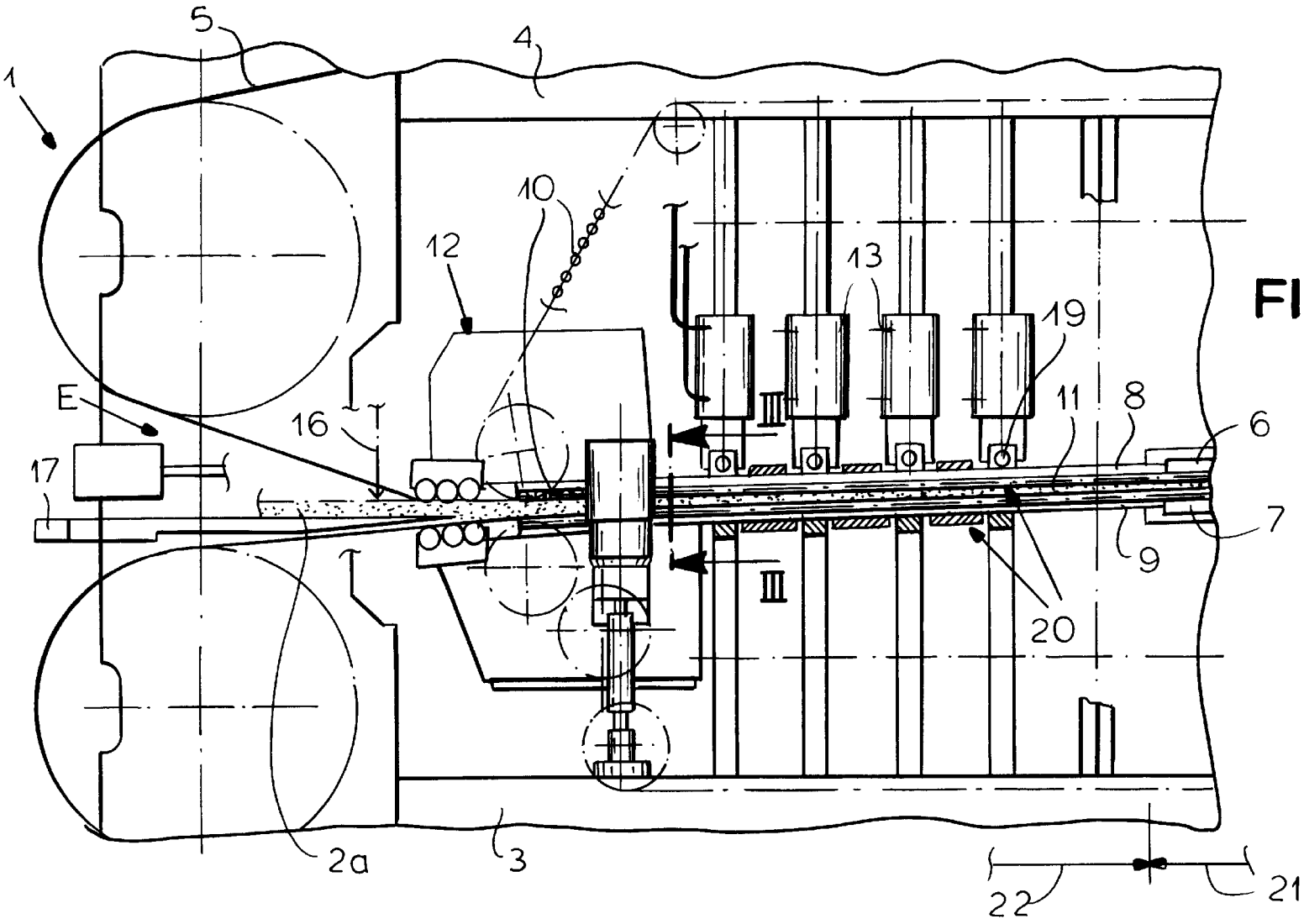

As seen in FIGS. 1 and 2 a press 1 according to the invention serves to compress a thick mat 2 or a thin mat 2*a* of particles and binder. It has a frame formed by a lower part 3 and an upper part 4. A pair of endless stainless-steel belts 5 have confronting lower and upper stretches riding over heated press platens 6 and 7 and flexible intake plates 8 and 9 to define a pressing gap 11 extending in a horizontal mat transport direction D and having an intake mouth E that opens upstream in the direction D. This gap 11 is basically subdivided into an upstream portion 22 at the mouth E where the mat 2 or 2*a* is compressed down to its finished size, and a downstream portion 21 in which the mat 2 or 2*a* is held at this compressed size and heated to fix its binder. Respective arrays of rollers 10 ride between the belts 5 and the plates 6–9 to allow the belts 5 to move smoothly with little friction. The gap 11 starts at the intake mouth E where in FIG. 1 it is relatively wide to accommodate the mat 2 which is about 100 mm thick to start with and ends at a spacing equal to the thickness of the finished panel, typically around 16 mm.

According to the invention the press 1 has a system 12 for setting the shape of the belts 5 and plates 8 and 9 at the intake mouth E and along the gap 11. This system 12 comprises a plurality of actuators constituted as hydraulic differential or double-acting cylinders 13 aligned in longitudinal and transverse rows and braced in the illustrated embodiment between the press part 4 and the plate 8. A common controller 15 is connected via a hydraulic network 14 to the array of actuators 13 to control them individually.

Position sensors 16 are provided along the mouth E to detect the position of the belts 5 and/or the thickness of the mat 2 or 2*a* at various locations normally corresponding to the locations of the actuators 13. In addition a feed device 17 is shown for directing the mat 2 or 2*a* directly into the center of the mouth E.

Figure 3:
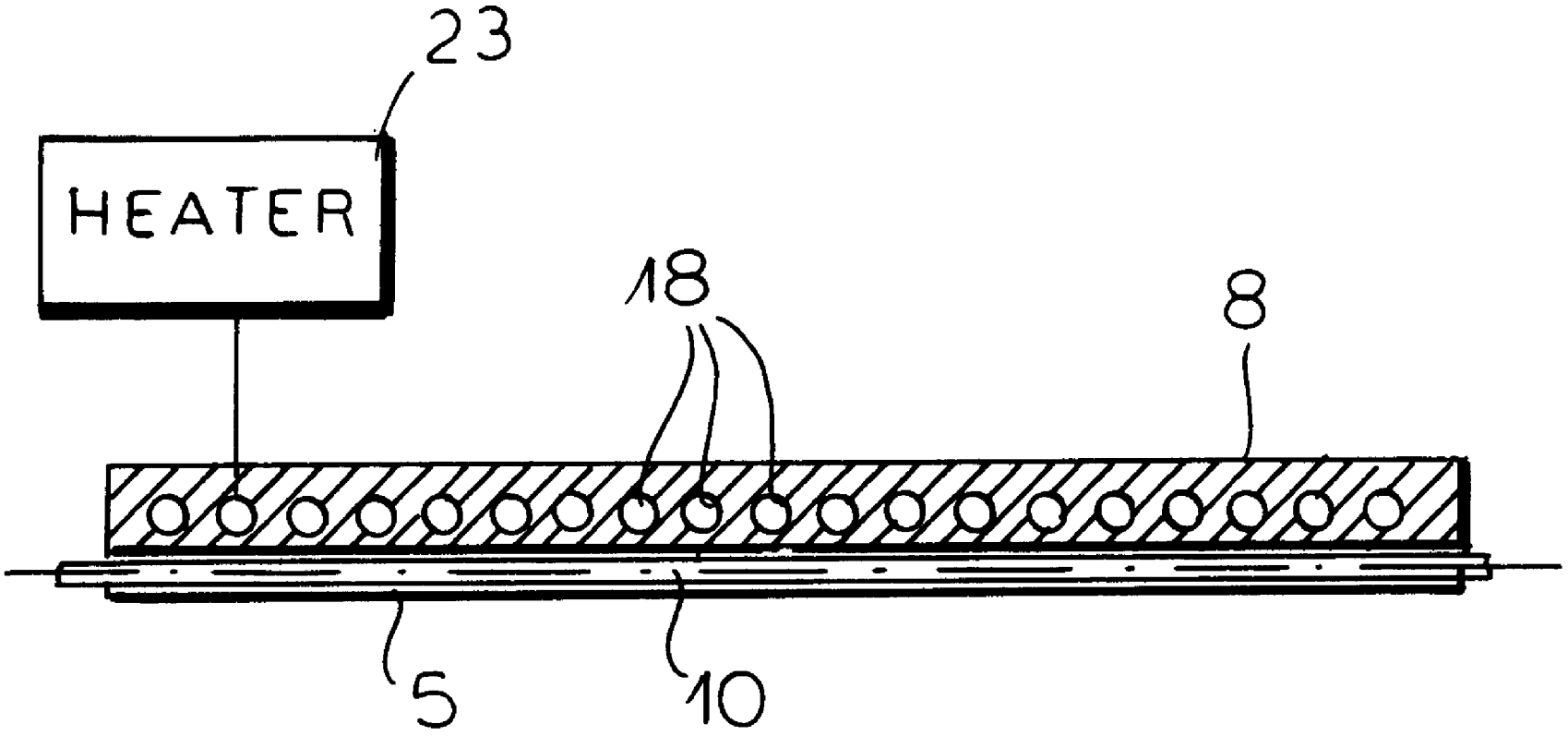
FIG. 3 is a section taken along line III—III of FIG. 2.

As mentioned, the plates 8 and 9 are heated by a heating device shown schematically in FIG. 3 at 23. To this end FIG. 3 also shows how the plate 8 is formed with an array of bores 18 that extend longitudinally, that is in the transport direction, so that a heated liquid or steam can be pumped through this plate 8 to heat it and activate the binder in the mat 2 or 2*a*. The bores 18 make the plates 8 and 9 particularly flexible without weakening it in a manner that would cause premature failure or irregular bending. The actuators 13 bear via universal or cardan joints 19 on the back face of the plate 8. These joints could also be provided at the upper ends of the actuator 13, between them and the frame 4.

To protect the actuators 13, insulation 20 is provided between them and the plate 8. In addition a cooler 24 may be provided to cool the fluid going into the actuators 13 to prevent them from overheating.

We claim:

1. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

respective arrays of rollers between each press plate and the respective stretch;

upper and lower flexible intake plates juxtaposed respectively above and below upstream ends of the lower and upper stretches of the belts and defining therewith an intake mouth flaring upstream;

an array of longitudinally and transversely spaced fluid-powered actuators braced between at least one of the intake plates and the frame and operable to flex and deform the one intake plate and thereby change the curvature of the one intake plate and relative positions of the belts at the mouth; and control means connected to the actuators for selectively operating same and thereby changing the curvature of the one intake plate and relative positions of the belts at the mouth.

2. The press defined in claim 1 wherein the actuators are arrayed in longitudinal and transverse rows.

3. The press defined in claim 1, further comprising a cardan joint between each of the actuators and the one intake plate.

4. The press defined in claim 1, further comprising heat insulation between the actuators and the one intake plate.

5. The press defined in claim 1 wherein the actuators are double-acting hydraulic rams.

6. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

respective arrays of rollers between each press plate and the respective stretch;

upper and lower flexible intake plates juxtaposed respectively above and below upstream ends of the lower and upper stretches of the belts and defining therewith an intake mouth flaring upstream, the one intake plate being formed with longitudinally extending bores;

an array of longitudinally and transversely spaced fluid-powered actuators braced between at least one of the intake plates and the frame and operable to flex and deform the one intake plate and thereby change the curvature of the one intake plate and relative positions of the belts at the mouth;

control means connected to the actuators for selectively operating same and thereby changing the curvature of the one intake plate and relative positions of the belts at the mouth; and means for circulating a heating fluid through the bores.

7. A press for pressing a mat into a thin panel, the press comprising:

a press frame;

upper and lower press plates on the frame;

upper and lower press belts having confronting lower and upper stretches defining a press gap extending in a horizontal and longitudinal transport direction and respectively running below and above the upper and lower press plates;

respective arrays of rollers between each press plate and the respective stretch;

upper and lower flexible intake plates juxtaposed respectively above and below upstream ends of the lower and upper stretches of the belts and defining therewith an intake mouth flaring upstream;

an array of longitudinally and transversely spaced fluid-powered actuators braced between at least one of the intake plates and the frame and operable to flex and deform the one intake plate and thereby change the curvature of the one intake plate and relative positions of the belts at the mouth;

control means connected to the actuators for selectively operating same and thereby changing the curvature of the one intake plate and relative positions of the belts at the mouth; and a hydraulic fluid network between the control means and the actuators; and means for cooling the fluid in the network.

* * * * *